United States Patent [19]

Calhoun et al.

[11] 4,351,388

[45] Sep. 28, 1982

[54] INVERTED MENISCUS HEAT PIPE

[75] Inventors: Leslie D. Calhoun, Creve Coeur; Marion E. Peeples, Florissant, both of Mo.

[73] Assignee: McDonnell Douglas Corporation, Long Beach, Calif.

[21] Appl. No.: 159,220

[22] Filed: Jun. 13, 1980

[51] Int. Cl.[3] ..... F28D 15/00

[52] U.S. Cl. ..... 165/104.26

[58] Field of Search ..... 165/104.26

[56] References Cited

U.S. PATENT DOCUMENTS 3,734,173 5/1973 Moritz ..... 165/104.26

3,892,273 7/1975 Nelson ..... 165/104.26

3,901,311 8/1975 Kosson et al. ..... 165/104.26

*Primary Examiner*—Albert W. Davis, Jr.

*Attorney, Agent, or Firm*—Paul T. Loef; George W. Finch; Donald L. Royer

[57] ABSTRACT

A high conductance heat pipe with annular grooves engaging a composite wick having a porous sheath containing a capillary core of glass beads and arranged to provide at least one axial vapor passage. The working fluid projects through the screen sheath to expose the meniscus to the heated surface at the evaporator end of the heat pipe to provide thin film boiling. The annular grooves conduct the vapor to the vapor channel.

17 Claims, 7 Drawing Figures

INVERTED MENISCUS HEAT PIPE

BACKGROUND OF THE INVENTION

This invention pertains to heat pipes, and more particularly to heat pipes employing thin film boiling.

A great deal of research has been conducted in recent years on heat pipes, sparked by extra-terrestrial applications which offer a very cold environment for the condenser and the heat pipe does not have to pump against the gravitational field of the earth. An exemplary of this research is exhibited in *A Collection of Technical Papers* delivered, and later published, at the third international heat pipe conference at Palo Alto, Calif. on May 22–24, 1978 by the American Institute of Aeronautics and Astronautics, Inc. Most of this research was directed at certain phenomena which effect heat pipe operation.

Axial groove heat pipes have become the industry standard dispite the fact that the conductance of this type heat pipe is far from optimum. The popularity of this type pipe is probably due to the ease of fabrication. Because of the pool boiling characteristic of this type pipe other parameters which influence the functioning of the pipe need not be controlled as precisely as in the case of thin film boiling. Very high heat transfer coefficients are associated with very thin liquid films. One method of achieving thin film boiling in a heat pipe is to present the meniscus of the fluid to the heated surface of the evaporator. In other words, the meniscus would be inverted from that typically found in the axial groove heat pipe. However, it is readily acknowledged that the influence parameters, indicated above, need be more precisely controlled when the meniscus is presented to the heated surface to avoid a burn out. A burn out may be defined as the transition from a completely wet evaporator to a partially dry evaporator. Avoiding a burnout is critical as it represents the practical heat transfer limit of the pipe beyond which it ceases to function. Some of these influence parameters seriously affect the shape of the meniscus. As a practical matter, the pumping power, which is determined by the capillary structure, must be as great as the pressure drop to the capillary structure and the wick plus any head that needs to be overcome e.g. the difference in elevation between the ends of the heat pipe. Capillary pressure is determined by the surface tension of the working fluid and the maximum possible curvature of the menisci in the capillary structure according to the classical Young-Laplace relation. Mechanical equilibrium at the liquid-vapor interface is critical. Excesses of pressure on either the vapor side of the interface or the liquid column hydrostatic pressure cause the menisci to either recede in or to extend out though the capillary screen. Elements must be provided within the heat pipe to control critical influence parameters to control the shape of the meniscus between these two extremes for efficient heat transfer.

SUMMARY OF THE PRESENT INVENTION

It is an important object of the present invention to provide a high conductance heat pipe wherein the high conductance is provided by high coefficients of heat transfer resulting from thin film boiling.

Another object of this invention is to provide elements in the heat pipe to control the critical influence parameters and thereby allow greater design flexibility in the application of the heat pipe along with fabrication simplicity which approaches that of the axial groove heat pipe.

In summary, the heat pipe of this invention accomplishes the above objects and provides a high conductance heat pipe by providing a composite wick design which presents a controlled meniscus to circumferential grooves inside the pipe where thin film boiling occurs. The vapor is conducted via the circumferential grooves to an axial vapor channel, to the condenser portion of the tube where it condenses on the circumferential grooves and returns to the wick core for return to the evaporator portion of the pipe. The composite wick core has a high permeability cross-sectional area product which minimizes axial viscus liquid pressure losses of the working fluid flowing to the evaporator from the condenser. A small pore-sized sheath around the core provides high capillary pumping pressure and a controlled meniscus which is directly exposed to the evaporator and condenser heated and cooled surfaces for high heat transfer coefficients associated with very thin liquid films.

BRIEF DESCRIPTION OF THE DRAWINGS

With reference to the drawings, wherein like reference numerals designate like portions of the invention.

DESCRIPTION OF THE INVENTION

Figure 1:
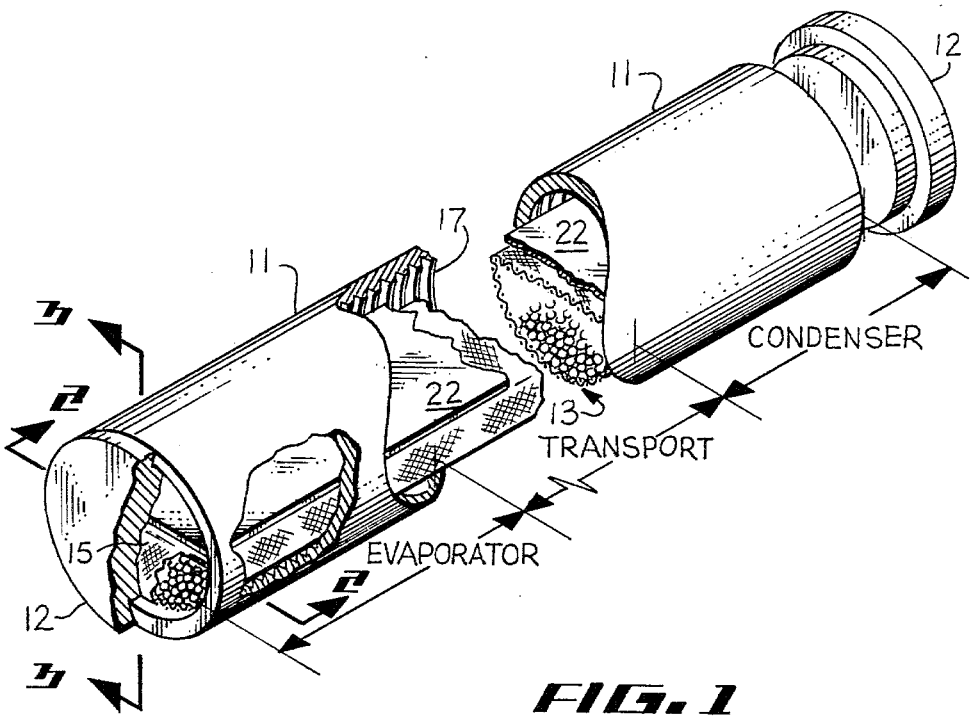
FIG. 1 is a perspective view of a fragmented embodiment of the invention with portions of the outside envelope removed to better depict the inner contents.

The typical embodiment of the heat pipe of this invention is shown in FIG. 1 with portions of the outside envelope 11, shown cylindrical in shape, removed to expose the composite wick 13. The end cap portion 12 of the envelope 11 is also removed for the same purpose. In this particular embodiment also shown in FIG. 2, the composite wick design is shown to consist of the wick core 14, which is composed of glass beads graded to 18–20 mesh diameter packed within a fine mesh 325×2300 twilled Dutch weave stainless steel screen 15. A seam weld shown at 16, axially closes the screen. Spot weld 19 attaches the mesh screen sheath 15 to the wick separator 22. The glass beads 14 are inserted into the screen sheath 15 through the open end and packed tightly in place with a mandrel aproximately the size of the eventual wick core cross section. Closure of the composite wick assembly at the condenser end of the heat pipe is accomplished by spot welding, not shown, after completion of the bead insertion. As discussed infra, the glass beads 14 are sized so as to accomplish a static capillary rise of the working fluid from the bottom of the pipe to the top. A graded capillary structure for both the core and sheath may be provided by axially increasing the bead size in the core and the pore size in the sheath from the evaporator to the condenser end of the heat pipe, if required. In this particular embodiment the working fluid is ammonia. However, in any case, it is necessary to saturate at least the wick portion contained in the evaporator end of the pipe with the working fluid. The mesh screen sheath 15 is the capillary structure and determines the pumping power of the heat pipe, as discussed previously.

Figure 3:
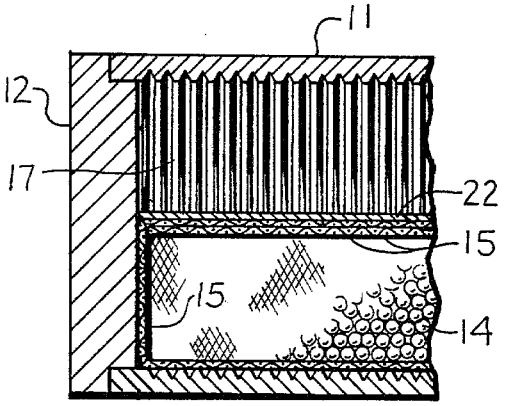
FIG. 3 is an enlarged frangmentary, longitudinal sectional view taken substantially as indicated by line 3—3, FIG. 1.
Figure 4:
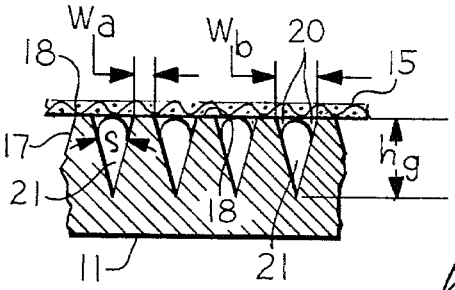
FIG. 4 is an enlarged view of the circumferential groove portion of the outside envelope showing a typical meniscus.

The inside diameter of the envelope 11 is provided with circumferential grooves 17, FIG. 3; having a flattened inside diameter portion at 18, FIG. 4. Having the meshed screen or porous sheet 15 in intimate contact with the flat portion 18 of the circumferential groove 17 is essential to proper functioning of the heatpipe.

Two liquid menisci are shown in the circumferential groove 17 of FIG. 4 and are identified as 20 with a vapor space 21 provided between the two menisci and occupying the balance of the groove 21. Mechanical equilibrium must occur at the interface between the meniscus 20 and the vapor space 21. A burnout occurs when the meniscus is lost over the pores in the sheath. In the particular embodiment described, the circumferential grooves 17 are on a helix with 60 grooves per inch, with the following dimensions:

$W_a=0.0027$, $W_b=0.014$, $H_g=0.011$, all in inches and $s=66°$. The helix is not essential and all groove dimensions should be tailored to the particular application.

Figure 2:
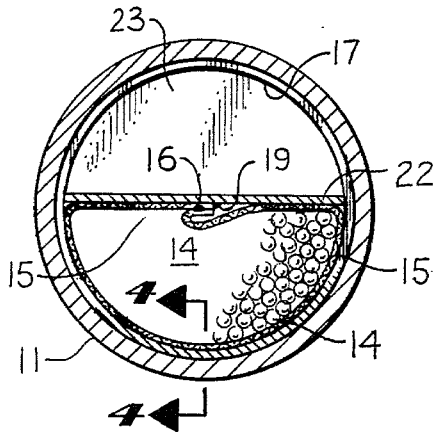
FIG. 2 is an enlarged sectional view taken substantially as indicated by line 2—2, FIG. 1.

In the preferred embodiment, as shown in FIG. 2, a wick separator 22 is installed against the composite wick 13 to form a vapor channel 23 and to isolate the vapor from the working liquid in the wick to avoid entrainment of liquid droplets in the vapor. Entrainment can occur where vapor velocities are high. In the particular embodiment shown in FIG. 2, the wick separator was formed by a 6 mil stainless steel strip, spot welded to the screen sheath 15. Installation of the wick separator 22 is a matter of design choice, provided it does not interfere with vapor passage in the groove 17.

Heat is applied to the evaporator end of the envelope 11 causing the working fluid to evaporate from the thread grooves 17 at this end of the heat pipe. The vapor follows the thread grooves 17 circumferentially until it arrives at the axial vapor channel 23 and it travels in this channel through the transport or adiabatic section to the condenser end of the heat pipe, due to differential pressure. Heat is removed from the vapor at the condenser end of the heat pipe causing the vapor to condense on the groove walls. The condensate travels to the screen sheath 15, passes through the sheath into the wick core 14, and moves to the evaporator end by capillary action, thereby completing the cycle.

Figure 5:
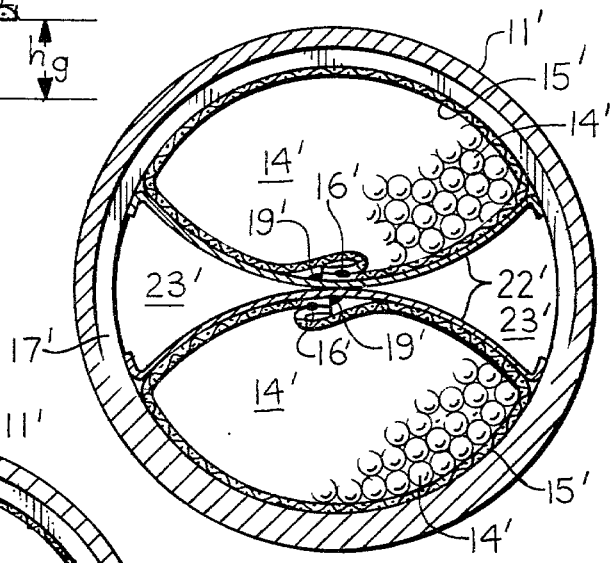
FIGS. 5, 6, and 7 are enlarged sectional views showing typical alternative embodiments of the inventive heat pipe.
Figure 6:
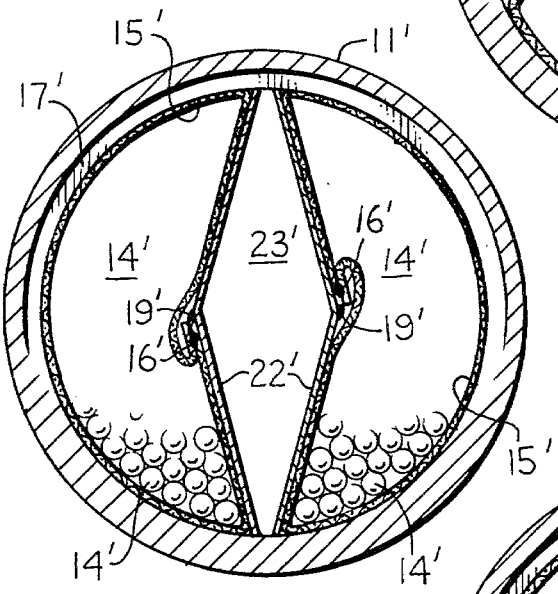
Figure 7:
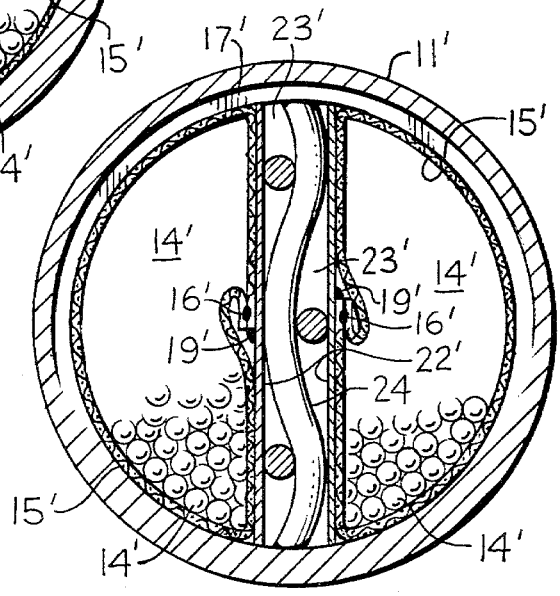

FIGS. 5, 6, and 7 are sections through heat pipes similar to that of FIG. 2 showing alternative embodiments. Elements which are essentially the same are designated with a like single primed reference numeral and are considered to be self-explanatory. The separator 24 in FIG. 7 is simply a larger screen used to separate the two composite wicks and does not perform exactly the same function as the wick separators 22 and 22' since the sheath 15' exposed to the vapor channel is not shrouded from the vapor.

It should now be reasonably clear that for each heat pipe application the various elements in the heat pipe, e.g. the pore sizes in the wick core 14 and the screen sheath 15 and the vapor channel 23, must be sized for each application and are influenced by such things as the choice of working fluid, heat rates, and the length of the pipe.

It may thus be seen that the arrangement of the elements depicted in the several embodiments of this invention serve to produce a heat pipe that is characterized by thin film boiling and the liquid and vapor phases are controlled to produce a pipe with substantially higher conductance while avoiding burnout.

Certain exemplary embodiments of this invention have been described above and shown in the accompanying drawings. It is to be understood that such embodiments are merely illustrative of, and not restrictive on, the board invention. It is not intended to limit the invention to the specific arrangements, constructions or structures described or shown, for various modifications thereof may occur to persons having ordinary skill in the art.

What is claimed is:

1. A heat pipe having evaporator, transport, and condenser portions comprising:

an enclosure envelope having an axial passage with circumferential grooves therein;

at least one composite wick having a capillary core means with a porous sheath, having a pore size smaller than that of said core means, surrounding and in intimate, continuous contact with said core where said sheath contacts said grooves, axially oriented in said passage and having a cross sectional area less than the cross sectional area of said passage so as to provide at least one axial vapor channel adjacent said composite wick which has at least one axial access path to said circumferential grooves;

means to retain said composite wick having a capillary core means and a porous sheath in intimate contact with said circumferential grooves in said passage; and a working fluid in said enclosure which wets said circumferential grooves and has sufficient surface tension so as to insure a static capillary rise in said composite wick so as to saturate said wick at least in said evaporator portion of said heat pipe so that as heat is applied to said heat pipe, said working fluid is vaporized at the outside diameter of said circumferential grooves and trapped between the meniscus of said working fluid as it emerges from said pores in said sheath by capillary action maintaining said meniscus in a concave or inverse shape since the working fluid adheres to the minor diameter of said circumferential grooves, whereby a very thin liquid film is maintained where the heat transfer takes place as said vapor cannot escape until it reaches said axial access path.

2. The heat pipe of claim 1 wherein said means to retain said composite wick having a capillary core means and a porous sheath in intimate contact with said circumferential grooves is also a separator so as to shroud the interfacing portion of said sheath from said vapor passage.

3. The heat pipe of claim 2 wherein said capillary core means of said composite wick is composed of beads stacked in said porous sheath.

4. The heat pipe of claim 3 wherein said beads are stacked in graded size from small to large so as to provide a graded capillary structure.

5. The heat pipe of claim 1 wherein said circumferential grooves are a vee-section with a flattened surface on the innermost portion of said axial passage which engages said porous sheath portion of said composite wick.

6. The heat pipe of claim 5 wherein said vee-section grooves are spaced in the range of 60 grooves per axial inch.

7. The heat pipe of claim 5 wherein said vee-section grooves are on a helix.

8. The heat pipe of claim 6 wherein said vee-section grooves are in the range of 0.010 inches deep.

9. The heat pipe of claim 8 wherein the width of said flat surface between said vee grooves on said innermost portion of said axial passage is in the range of 0.003 inches.

10. The heat pipe of claim 1 wherein said at least one composite wick is two composite wicks arranged to provide at least one vapor passage therebetween and wherein said means to retain said composite wick are two separators one each to separate the interface between one of said two composite wicks and said vapor passage.

11. A heat pipe having evaporator, transport, and condenser portions comprising:

an enclosure envelope having an axial passage with circumferential grooves therein;

at least one composite wick having a capillary core means and a porous sheath surrounding said core, axially oriented in said passage and having a cross-sectional area less than the cross-sectional area of said passage so as to provide at least one axial vapor channel adjacent said composite wick;

a separator spanning from one portion of said circumferential grooves to another so as to form a chord biasing said porous sheath containing said capillary core means into intimate contact with said circumferential grooves and shrouding said interfacing portion of said sheath from said vapor passage; and a working fluid in said enclosure, having sufficient surface tension so as to insure a static capillary rise in said composite wick so as to saturate said wick at least in said evaporator portion of said heat pipe.

12. The heat pipe of claim 11 wherein said capillary core means of said composite wick is composed of beads stacked in said porous sheath.

13. The heat pipe of claim 11 wherein said beads are stacked in graded size from small to large so as to provide a graded capillary structure.

14. The heat pipe of claim 11 wherein said at least one composite wick is two composite wicks arranged to provide at least one vapor passage therebetween and wherein said means to retain said composite wick are two separators one each to separate the interface between one of said two composite wicks and said vapor passage.

15. A heat pipe having evaporator, transport, and condenser portions comprising:

an enclosure envelope having an axial passage with circumferential grooves therein;

at least one composite wick having a capillary core means with a porous sheath, having a pore size smaller than that of said core means, surrounding and in intimate continuous contact with said core where said sheath contacts said grooves, axially oriented in said passage and having a cross-sectional area less than the cross-sectional area of said passage so as to provide at least one axial vapor channel adjacent said composite wick which has at least one axial access path to said circumferential grooves;

a separator spanning from one portion of said circumferential grooves to another so as to form a chord biasing said porous sheath containing said capillary core means into intimate contact with said circumferential grooves and shrouding said interfacing portion of said sheath from said vapor passage; and a working fluid in said enclosure which wets said circumferential grooves and has sufficient surface tension so as to insure a static capillary rise in said composite wick so as to saturate said wick at least in said evaporator portion of said heat pipe so that as heat is applied to said heat pipe, said working fluid is vaporized at the outside diameter of said circumferential grooves and trapped between the meniscus of said working fluid as it emerges from said pores in said sheath by capillary action maintaining said meniscus in a concave or inverse shape since the working fluid adheres to the minor diameter of said circumferential grooves whereby a very thin liquid film is maintained where the heat transfer takes place as said vapor cannot escape until it reaches said axial access path.

16. The heat pipe of claim 15 wherein said capillary core means of said composite wick is composed of beads stacked in said porous sheath.

17. The heat pipe of claim 15 wherein said beads are stacked in graded size from small to large so as to provide a graded capillary structure.

* * * * *